United States Patent [19]

Wickenberg

[11] 4,015,886

[45] Apr. 5, 1977

[54] STORAGE BINS

[76] Inventor: Chester H. Wickenberg, 1125 Forest Drive, Elgin, Ill. 60120

[22] Filed: Nov. 3, 1975

[21] Appl. No.: 627,849

[52] U.S. Cl. ..... 312/107; 312/111; 312/278; 312/351; 206/509

[51] Int. Cl.[2] ..... A47B 77/00; A47B 87/00; F16B 12/00; A47B 81/00

[58] Field of Search ..... 312/111, 107, 198, 278, 312/279; 206/504, 509, 518; 211/128

[56] References Cited

UNITED STATES PATENTS

| | | | |
|---|---|---|---|
| 1,739,730 | 12/1929 | Orthwine | 312/278 |
| 2,064,518 | 12/1936 | Brogden | 206/504 |
| 2,456,481 | 12/1948 | Ballantyne et al. | 206/509 |
| 2,537,219 | 1/1951 | Girton | 312/107 |
| 2,891,678 | 6/1959 | Levy | 211/126 |
| 3,252,614 | 5/1966 | Evans | 206/509 |
| 3,502,294 | 3/1970 | Kalbow et al. | 211/71 |
| 3,606,949 | 9/1971 | Joyce | 206/509 |

FOREIGN PATENTS OR APPLICATIONS

| | | | |
|---|---|---|---|
| 361,239 | 5/1962 | Switzerland | 206/509 |
| 1,290,959 | 9/1972 | United Kingdom | 211/128 |

*Primary Examiner*—Paul R. Gilliam
*Assistant Examiner*—V. N. Sakran
*Attorney, Agent, or Firm*—Edward D. Gilhooly

[57] ABSTRACT

A storage and display system includes a plurality of bins adapted to be stacked and interlocked in a vertical array and tier-supporting members including at least two brackets adapted to be detachably interlocking to form horizontal and vertical supporting surfaces for the bins. Each bin consists of a bottom, a substantially upstanding front wall and an upstanding rear wall. Each bottom of the bins has a front flange member and a rear flange member arranged on its outside surface. Each upstanding rear wall of the bins has an additional flange member positioned on its upper end. A first bin is positioned onto the supporting members by interengaging the front and rear flange members on the bottom of the first bin with hook-shaped projections on the brackets. A second bin is stacked above the first bin by interengaging the additional flange member on the upper end of the rear wall of the first bin with the front flange member on the bottom of the second bin and by interengaging the rear flange member on the bottom of the second bin with the supporting members. A third bin is stacked above the first and second bins by interengaging the additional flange member on the upper end of the rear wall of the second bin with the front flange member on the bottom of the third bin and by interengaging the rear flange member on the bottom of the third bin with the supporting members. A plurality of partition members is provided for dividing each of the bins into a desired number of compartments. Each of the partition members is adjustable laterally along the entire width of the bins to provide substantially infinite variations of compartment sizes.

12 Claims, 10 Drawing Figures

Fig. 1
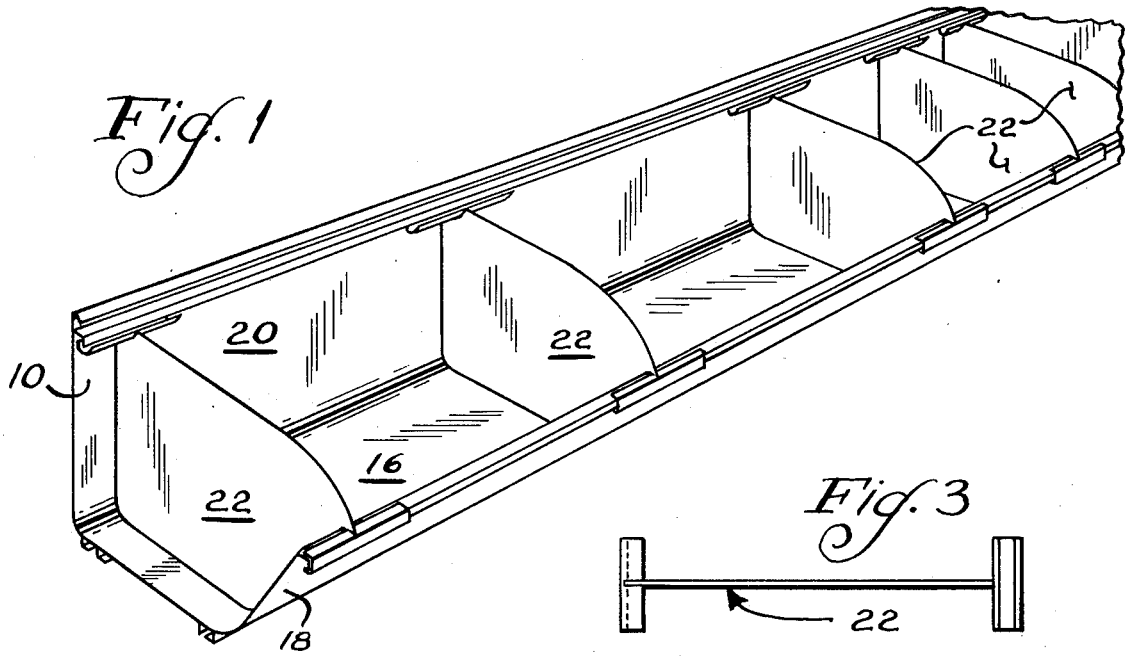
Fig. 3
Fig. 2
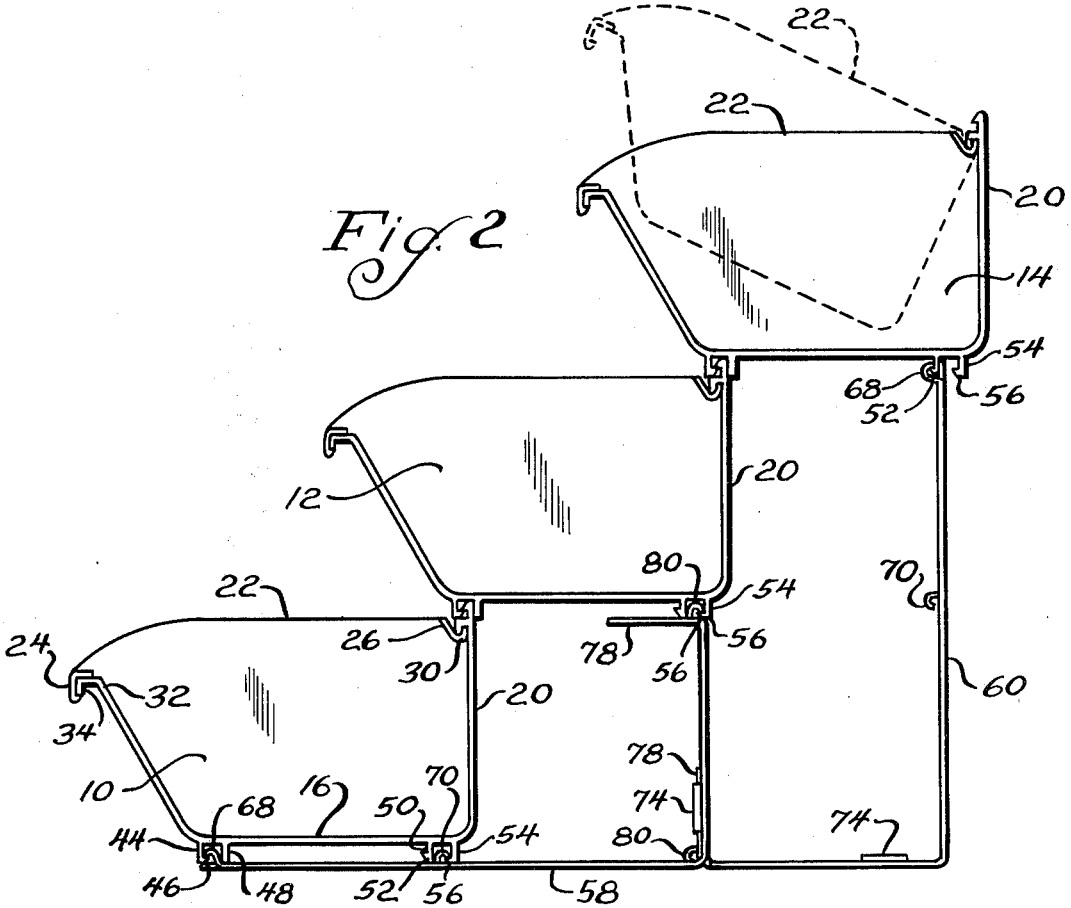

STORAGE BINS

BACKGROUND OF THE INVENTION

This invention relates generally to bins for displaying and storing articles and the like. More particularly, it relates to a bin that can be stacked and interlocked in a vertical array with other similar bins. Removable partition or wall members can be provided within the bins to provide substantially infinite lateral adjustability of the individual compartments formed therein whereby any desired number and size of the compartments can be obtained.

Heretofore, it has been encountered that the amount of horizontal space available for storage and display of articles is quite often very limited. It would, therefore, be desirable to have a bin that can be stacked with other similar bins in a vertical array. These bins could be interengaging with each other in order to increase the area for storage and display that is required and still be maintainable within the given horizontal space available.

Further, the sizes of the various articles which are to be stored and displayed are quite likely to be different. Thus, it would be advantageous to have a bin which could be divided into many compartments so as to accommodate the various articles of different sizes.

SUMMARY OF THE INVENTION

Accordingly, it is an object of the present invention to provide a bin which has all of the aforementioned features and advantages.

Another object of the present invention is to provide a storage and display system of relatively simple construction which is inexpensive to manufacture and easy to assemble for use.

Still another object of the present invention is to provide a bin that can be stacked and interlocked in a vertical array with other similar bins to occupy a minimum amount of horizontal space.

Yet another object of the present invention is to provide a bin having one or more removable partition members which can be adjustable laterally along the entire width of the bin to give substantial infinite variations of compartment sizes.

In accordance with these aims and objectives, the present invention is concerned with the provisions of a storage and display system which includes a plurality of bins adapted to be stacked and interlocked in a vertical array and tier-supporting members consisting of at least two brackets adapted to be detachably interlocking to form a horizontal and vertical supporting surfaces for the bins. Each of the bins has a bottom, a substantially upstanding front wall and an upstanding rear wall. Each bottom of the bins has a front flange member and a rear flange member arranged on its outside surface. Each upstanding rear wall of the bins has an additional flange member positioned on its upper end. A first bin is positioned onto the supporting members by interengaging the front and rear flange members on the bottom of the first bin with hook-shaped projections on the brackets. A second bin is stacked above the first bin by interengaging the additional flange member on the upper end of the rear wall of the first bin with the front flange member on the bottom of the second bin and by interengaging the rear flange member on the bottom of the second bin with the supporting members. A third bin is stacked above the first and second bins by interengaging the additional flange member on the upper end of the rear wall of the second bin with the front flange member on the bottom of the third bin and by interengaging the rear flange on the bottom of the third bin with the supporting members.

Additionally, a plurality of partition members are provided for dividing each of the bins into a desired number of compartments. Each of the partition members is adjustable laterally along the entire width of the bins to provide substantially infinite variations of compartment sizes.

The present invention is particularly efficient and economical in providing a storage and display system since it is formed of very few components and can be readily assembled without the use of additional fastening members and the like. Additionally, the instant storage and display system is relatively simple in construction and is inexpensive to manufacture and easy to assemble for use.

Further, the storage and display system of the instant invention is provided with a bin that can be stacked and interlocked in a vertical array with other similar bins thereby minimizing the amount of horizontal space. Moreover, a plurality of partition members are provided for dividing each of the bins into a desired number of compartments. Each of the partition members is adjustable laterally along the entire width of the bins to provide substantially infinite variations of compartment sizes in order to accommodate the various articles of different sizes.

BRIEF DESCRIPTION OF THE DRAWINGS

These and other objects and advantages of the present invention will become more fully apparent from the following detailed description when read in conjunction with the accompanying drawings, wherein:

FIG. 1 shows a perspective view of a bin of the present invention illustrating a plurality of removable partition members;

FIG. 2 shows a side elevational view of three bins generally similar to that of FIG. 1 but depicting how the storage and display system of the present invention can be stacked and interlocked in a three-tier system and depicting in phantom how a removable partition member is fitted into a bin;

FIG. 3 shows a top view of a removable partition interlocked within a bin, according to the present invention;

DETAILED DESCRIPTION OF THE PREFERRED EMBODIMENT

Figure 4:
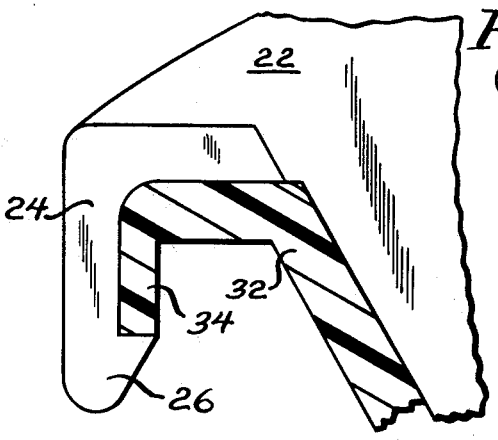
FIG. 4 shows an enlarged view, in section, of the details of the interlocking engagement of the front portion of the removable partition member and the top front portion of the bins.

Referring now in detail to the drawings, only three identical bins designated 10, 14 and 12 for a storage and display system are shown in FIG. 2 for the purpose of convenience in illustrating and describing the stacking and interlocking features of the bins, although the invention is not to be so limited. Since all the bins are identical, like parts of the various bins are designated with the same reference numerals in all of the drawings.

The bins 10, 14 and 12 can be formed from a variety of materials, in particular, a material such as plastic, is suitable since the bins are essentially of a unitary extruded construction. Each of the bins, which bin 10 as shown in FIG. 1 will be taken as representative, is generally formed of a flat horizontal bottom 16, an upstanding and outwardly angled front wall 18 and an upstanding rear wall 20. The width of the bin 10 can be of any desired size.

A plurality of removable partition members 22 can be arranged at different positions along the width of the bin 10 to divide the area into a number of separate compartments each of which can be utilized to store and display articles of various sizes (FIG. 1). Each of the partition members can be adjusted laterally along the entire width of the bin to fit at substantially infinite number of positions.

Figure 5:
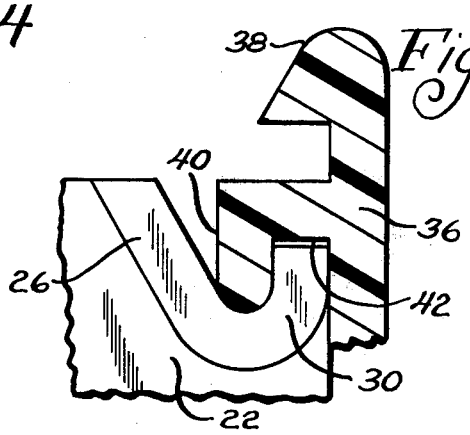
FIG. 5 shows an enlarged view, in section, of the details of the interlocking engagement of the rear portion of the removable partition member and the top rear portion of the bin.
Figure 6:
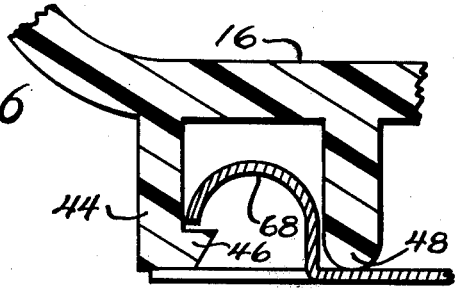
FIG. 6 shows an enlarged view, in section, of the details of the interlocking engagement of the bottom portion of the bin and the bracket.

As shown in FIGS. 2 and 4, the front end of the partition member 22 is provided with an outwardly projecting flange 24 which has a hook-shaped outer end 26. The rear end of the partition member, according to FIGS. 2 and 5, is provided with an outwardly projecting flange 28 which has a curved-portion 30. The hook-shaped outer end 26 and the curved-portion 30 of the partition member 22 cooperatively interengage so as to be detachably interlocking with portions of the bins as will be more fully described hereinafter.

The front wall 18 of the bin 10 as best seen in FIG. 4 is provided at its upper end with a flange portion 32 which has a downwardly extending section 34. The rear wall 20, as best seen in FIG. 5, is provided at its upper rear end with a flange portion 36 which has a top section 38 and a downwardly extending bottom section 40. As shown in phantom line in FIG. 2, the partition member 22 may be inserted into the bin 14 so that its curved-portion 30 fits into the recess 42 created by the downwardly extending bottom section 40 on the upper end of the rear wall 20. The partition member 22 is then pressed downwardly until its hook-shaped outer end 26 snaps under or interlocks with the downwardly extending section 34. Thus, the partition member 22 cooperatively engages and detachably interlocks with the bins so that there is eliminated the need for any fastening structures such as welding or bolts and the like.

The flange portions 32 and 36 may be made of any particular width as desired. Any number of partition members may be fitted into the bins to provide a desired number of separate compartments. Further, each of the partition members may be adjusted laterally along the entire width of the bin to give substantially infinite variations of compartment sizes.

Figure 7:
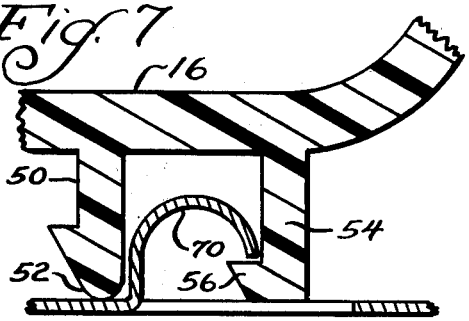
FIG. 7 shows an enlarged view, in section, of the details of the interlocking engagement of the bottom rear portion of the bin and the bracket.

As shown in FIGS. 2 and 4, the front end of the bottom 16 of the bin 10 has a downwardly extending flange 44 which is provided with an end portion 46. The front end of the bottom 16 is further provided with a downwardly projecting flange 48 which extends parallel to and is spaced at a short distance from the flange 44. The flange 48 has a length substantially equal to the length of the flange 44. According to FIGS. 2 and 7, the rear end of the bottom 16 of the bin 10 has a downwardly extending flange 50 which is provided with an end portion 52. The rear end of the bottom 16 is further provided with a downwardly projecting flange 54 having an end portion 56. The flange 54 extends parallel to and is also spaced at a short distance from the flange 50. The length of the flange 54 is substantially equal to that of the flange 50.

Figure 9:
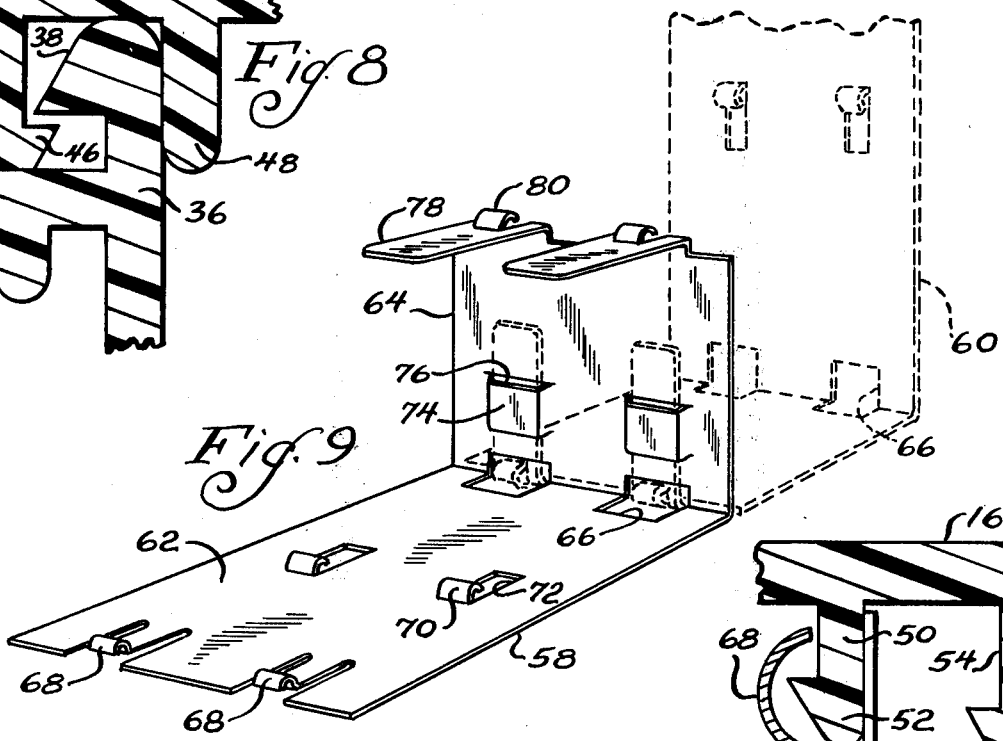
FIG. 9 shows a perspective view of a front bracket interfitted with a rear bracket shown in phantom of similar type.
Figure 10:
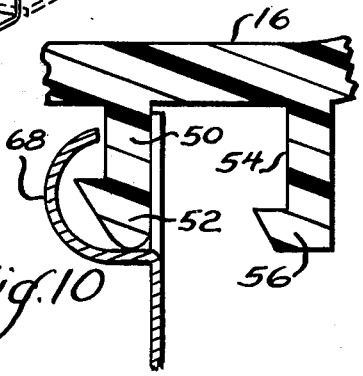
FIG. 10 shows an enlarged view, in section, of the details of the interlocking engagement of the bottom rear portion of the bin and the rear bracket.

In the illustrated three-tier system of FIG. 2 tier-supporting means such as two similar brackets 58 and 60 are adapted to be interengaging so as to form vertical and horizontal supporting surfaces for the bins 10, 12, and 14. Each bracket, which front bracket 58 as shown in FIG. 9 will be taken as representative, is preferably formed of a metal plate or the like. The bracket 58 has a first supporting surface 62 and a second supporting surface 64 which is made integral with the surface 62 to form an L-shaped member. At the junction of the supporting surfaces 62 and 64, a pair of recesses 66 are formed therein. A pair of hook-shaped projections 68 are formed on the end of the first supporting surface 62 distal the junction of the surfaces 62 and 64. Additionally, a pair of hook-shaped projections 70 are formed upwardly on the intermediate area of the first supporting surface 62, thereby leaving corresponding apertures 72 therein. On the second supporting surface 64, there are provided a pair of raised portions 74 forming slots 76 thereunder. A pair of tab-like projections 78 are formed on the end of the second supporting surface 64 distal the junction of the surfaces 62 and 64. The projections 78 extend in a direction substantially parallel to the supporting surface 62 and are provided at its one end with hook-shaped projections 80.

The front bracket 58 interengages and detachably interlocks with the rear bracket 60 via the insertion of the tab-like projections 78 on the rear brackets 60 into the slots 76 on the front bracket 58. After the interengagement of the brackets 58 and 60 as best seen in FIGS. 2 and 9, the bins can be then assembled onto the brackets for stacking so as to form a three-tier system. It is to be understood that the brackets may be easily modified and adapted to accommodate any numbered tier system as desired. Further the rear bracket 60 may be dispensed with in forming a two-tier system, as it is entirely unnecessary.

Figure 8:
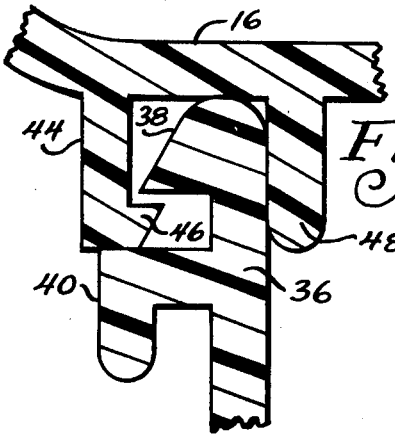
FIG. 8 shows an enlarged view, in section, of the details of the interlocking engagement of the top rear portion of one bin and the bottom front portion of the next adjacent bin.

In the operation of stacking the plurality of bins onto the brackets, the bin 10 (FIG. 2) is initially placed on the front bracket 58 so that the hook-shaped projections 70 co-operatively engage with the end portions 56 of the flange 54 on the rear bottom end of the bin 10. The bin 10 is then pressed downwardy until the hook-shaped projection 68 on the front bracket 58 snaps over the end portion 46 of the flange 44 on the front bottom end of the bin 10, thereby detachably interlocking the bin 10 onto the bracket 58. Next, the bin 12 is stacked by interengaging so as to detachably interlock the top section 38 of the flange 36 on the upper end of the bin 10 between the end portion 46 of the flange 44 and the flange 48 on the bin 12 (FIG. 8), and by interengaging so as to detachably interlock the hook-shaped projections 80 on the front bracket 58 with the end portion 56 of the flange 54 on the rear bottom end of the bin 12 (FIG. 2). Finally, the bin 14 is stacked above bins 10 and 12 by interengaging so as to detachably interlock the top section 38 of the flange 36 on the upper rear end of the bin 12 between the end portion 46 of the flange 44 and the flange 48 of the bin 14, and by interengaging so as to detachably interlock the hook-shaped projections 68 on the rear bracket 60 with the end portion 52 of the flange 50 on the bin 14.

From the foregoing description of the storage and display system embodying the present invention, it can be seen that there is provided an improved storage and display system wherein bins can be stacked and interlocked in a vertical array with other similar bins to occupy a minimum amount of horizontal space. Further, a plurality of partition members which are adjustable laterally along the entire width of the bins provide substantially infinite variations of compartment sizes. The storage and display system of the present invention is relatively simple in construction and can be assembled without the use of additional fastening structures.

While there has been illustrated and described what is at present to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as a best mode contemplated for carrying out this invention, but that the invention will include all embodiments falling within the scope of the appended claims.

What is claimed is:

1. A storage and display system comprising:

a plurality of bins adapted to be stacked and detachably interlocked in a vertical array;

tier-supporting means including at least two brackets adapted to be detachably interlocking to form horizontal and vertical supporting surfaces for the bins;

each of said plurality of bins consisting of a bottom, a substantially upstanding front wall and an upstanding rear wall;

each bottom of the bins having a front flange means and a rear flange means disposed on its outside surface, each upstanding rear wall of the bins having an additional flange means disposed on its upper end;

said brackets having hook-shaped projections adapted to interengage with the bins thereby detachably interlocking the bins onto the brackets;

said plurality of bins including at least three bins, a first bin of said at least three bins being positioned onto the supporting means so that the hook-shaped projections interengage with the front and rear flange means on the bottom of said first bin;

a second bin of said at least three bins being stacked above said first bin by interengaging so as to detachably interlock said additional flange means on the upper end of the rear wall of the first bin with the front flange means on the bottom of the second bin and by interengaging so as to detachably interlock the rear flange means on the bottom of the second bin with said supporting means; and a third of said at least three bins being stacked above the first and second bins by interengaging so as to detachably interlock said additional flange means on the upper end of the rear wall of the second bin with the front flange means on the bottom of the third bin and by interengaging so as to detachably interlock the rear flange means on the bottom of the third bin with said supporting means.

2. A storage and display system as claimed in claim 1, further comprising a plurality of partition members for dividing each of the bins into a desired number of separate compartments, each of the partition members being adjustable laterally along the entire width of the bins to provide substantially infinite variations of compartment sizes.

3. A storage and display system as claimed in claim 2, wherein the upstanding front wall has a flange portion with a downwardly extending section on its upper end, and wherein each of the partition members have a rear curved-portion for detachable engagement with a bottom section of the flange means on the upper end of the rear wall of the bin and a front outwardly projecting flange with a hook-shaped outer end for detachable engagement with the downwardly extending section of the flange portion on the upper end of the upstanding front wall on the bins.

4. A storage and display system as claimed in claim 1, wherein the front flange means on the bottom of the bins comprise a first downwardly extending flange having an end portion and a second downwardly projecting flange extending parallel thereto, the second flange being spaced at a short distance from the first flange and having a length substantially equal thereto.

5. A storage and display system as claimed in claim 1, wherein the rear flange means on the bottom of the bins comprise a first downwardly extending flange having an end portion and a second downwardly projecting flange extending parallel thereto, the second flange being spaced at a short distance from the first flange and having a length substantially equal thereto.

6. A storage and display system as claimed in claim 1, wherein the additional flange means on the upper end of the rear wall of the bins comprise a flange having a top section and a downwardly extending bottom section.

7. A storage and display system comprising:

at least two bins adapted to be stacked and detachably interlocked in a vertical array;

at least one supporting bracket adapted to form horizontal and vertical supporting surfaces for the bins;

each of said at least two bins consisting of a bottom, a substantially upstanding front wall and an upstanding rear wall;

each bottom the bin having a front flange means and a rear flange means disposed on its outside surface, each upstanding rear wall of the bins having an additional flange means disposed on its upper end;

said brackets having hook-shaped projections adapted to interengage with the bins thereby detachably interlocking the bins onto the bracket;

a first bin of said at least two bins being positioned onto said at least one supporting bracket so that the hook-shaped projections interengage with the front and rear flange means on the bottom of said first bin; and a second bin of said at least two bins being stacked above said first bin by interengaging so as to detachably interlock said additional flange means on the upper end of the rear wall of the first bin with the front flange means on the bottom of the second bin and by interengaging so as to detachably interlock the rear flange means on the bottom of the second bin with said at least one supporting bracket.

8. A storage and display system as claimed in claim 7, further comprising a plurality of partition members for dividing each of the bins into a desired number of separate compartments, each of the partition members being adjustable laterally along the entire width of the bins to provide substantially infinite variations of compartment sizes.

9. A storage and display system as claimed in claim 8, wherein the upstanding front wall has a flange portion with a downwardly extending section on its upper end, and wherein each of the partition members has a rear curved-portion for detachable engagement with a bottom section of the flange means on the upper end of the rear wall of the bins and a front outwardly projecting flange with a hook-shaped outer end for detachable engagement with the downwardly extending section of the flange portion on the upper end of the upstanding front wall on the bins.

10. A storage and display system as claimed in claim 7, wherein the front flange means on the bottom of the bins comprise a first downwardly extending flange having an end portion and a second downwardly projecting flange extending parallel thereto, the second flange being spaced at a short distance from the first flange and having a length substantially equal thereto.

11. A storage and display system as claimed in claim 7, wherein the rear flange means on the bottom of the bins comprise a first downwardly extending flange having an end portion and a second downwardly projecting flange extending parallel thereto, the second flange being spaced at a short distance from the first flange and having a length substantially equal thereto.

12. A storage and display system as claimed in claim 7, wherein the additional flange means on the upper end of the rear wall of the bins comprise a flange having a top section and a downwardly extending bottom section.

* * * * *